US007671273B2

(12) United States Patent
Douriet et al.

(10) Patent No.: US 7,671,273 B2
(45) Date of Patent: Mar. 2, 2010

(54) METHOD AND APPARATUS FOR FACILITATING SIGNAL TRANSMISSION USING DIFFERENTIAL TRANSMISSION LINES

(75) Inventors: Daniel Douriet, Round Rock, TX (US); Anand Haridass, Austin, TX (US); Andreas Huber, Baden-Wurttemberg (DE); Colm Brian O'Reilly, Austin, TX (US); Roger Donell Weekly, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/869,130

(22) Filed: Oct. 9, 2007

(65) Prior Publication Data

US 2009/0091401 A1 Apr. 9, 2009

(51) Int. Cl.
*H01B 11/02* (2006.01)

(52) U.S. Cl. ..... 174/33

(58) Field of Classification Search ..... 174/27, 174/32, 33, 36, 113 R
See application file for complete search history.

(56) References Cited

U.S. PATENT DOCUMENTS 3,763,306 A 10/1973 Marshall
5,471,010 A 11/1995 Bockelman et al.
6,162,922 A 12/2000 Anderson et al.
6,272,828 B1 * 8/2001 Walling et al. ..... 57/58.49
6,403,887 B1 6/2002 Kebabjian et al.
6,486,405 B2 * 11/2002 Lin ..... 174/113 R
6,486,492 B1 11/2002 Su
6,743,985 B1 * 6/2004 Carrier et al. ..... 174/261
6,899,550 B2 5/2005 Perugini et al.
7,009,105 B2 * 3/2006 Chou ..... 174/27
2005/0208823 A1 9/2005 Moriyama et al.

* cited by examiner

*Primary Examiner*—Chau N Nguyen
(74) *Attorney, Agent, or Firm*—Yee & Associates, P.C.; David A. Mims, Jr.

(57) ABSTRACT

The illustrative embodiments described herein provide an apparatus and method for facilitating signal transmission using differential transmission lines. The apparatus includes a first differential transmission line. The first differential transmission line includes a first plurality of conductors. The first plurality of conductors includes a set of conductors. The apparatus also includes a second differential transmission line. The second differential transmission line includes a second plurality of conductors. The second plurality of conductors includes a first conductor and a second conductor. A first noise produced by the first conductor on the set of conductors is balanced by a second noise produced by the second conductor on the set of conductors. The first differential transmission line and the second differential transmission line facilitate signal transmission.

17 Claims, 5 Drawing Sheets

METHOD AND APPARATUS FOR FACILITATING SIGNAL TRANSMISSION USING DIFFERENTIAL TRANSMISSION LINES

BACKGROUND OF THE INVENTION

1. Field of the Invention

The invention relates generally to a method and apparatus for facilitating signal transmission. More particularly, the present invention relates to a method and apparatus for facilitating signal transmission using differential transmission lines.

2. Description of the Related Art

Signals may be transmitted in data processing systems using techniques such as signal-ended signaling and differential signaling. A signal is any data capable of transmission. Differential signaling, which uses differential transmission lines to transmit a signal, is often preferred in applications that require an extra degree of noise immunity.

A differential transmission line is a plurality of electrical conductors that complement one another in the transmission of a signal. The signal transmitted by the differential transmission line is indicated by a voltage difference between the conductors in the differential transmission line. For example, a differential transmission line may include two wires that are substantially parallel to one another, and which transmit a signal as indicated by a voltage difference between the two wires. Any noise source that induces more voltage on one conductor than the other will add a net noise in the signal that is equal to the difference in noise between the conductors.

Differential signaling may be used in different contexts. For example, differential signaling may be used in computers, circuits, computer networks, data transmission connectors, cables, power grids, low voltage applications, high voltage applications, low frequency application, and high frequency applications.

Differential signaling may be used in analog signaling, such as the analog signaling used in some audio and video systems. Differential signaling may also be used in digital signaling. For example, differential signaling is used in the EIA-422 and EIA-485 specifications for signaling. EIA-422 is the technical standard that specifies the electrical characteristics of the balanced voltage digital interface circuit. EIA-485 is an open system interconnection model physical layer electrical specification of a two-wire, half-duplex, multipoint serial connection. EIA-422 and EIA-485 are now administered by the Telecommunications Industry Association. Other exemplary uses of differential signaling in digital signaling include the use of differential signaling in the peripheral component interconnect express (PCI Express) and universal serial bus interface types.

Differential signaling may also be used in the high-speed digital serial interfaces of low voltage differential signaling, serial advanced technology attachment (Serial ATA), hypertransport, and Ethernet. Other implementations of differential signaling may be found in emitter coupled logic (ECL), positive emitter coupled logic (PECL), low voltage positive emitter coupled logic (LVPECL), musical instrument digital interface (MIDI), transition minimized differential signaling, and firewire.

SUMMARY OF THE INVENTION

The illustrative embodiments described herein provide an apparatus and method for facilitating signal transmission using differential transmission lines. The apparatus includes a first differential transmission line. The first differential transmission line includes a first plurality of conductors. The first plurality of conductors includes a set of conductors. The apparatus also includes a second differential transmission line. The second differential transmission line includes a second plurality of conductors. The second plurality of conductors includes a first conductor and a second conductor. A first noise produced by the first conductor on the set of conductors is balanced by a second noise produced by the second conductor on the set of conductors. The first differential transmission line and the second differential transmission line facilitate signal transmission.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
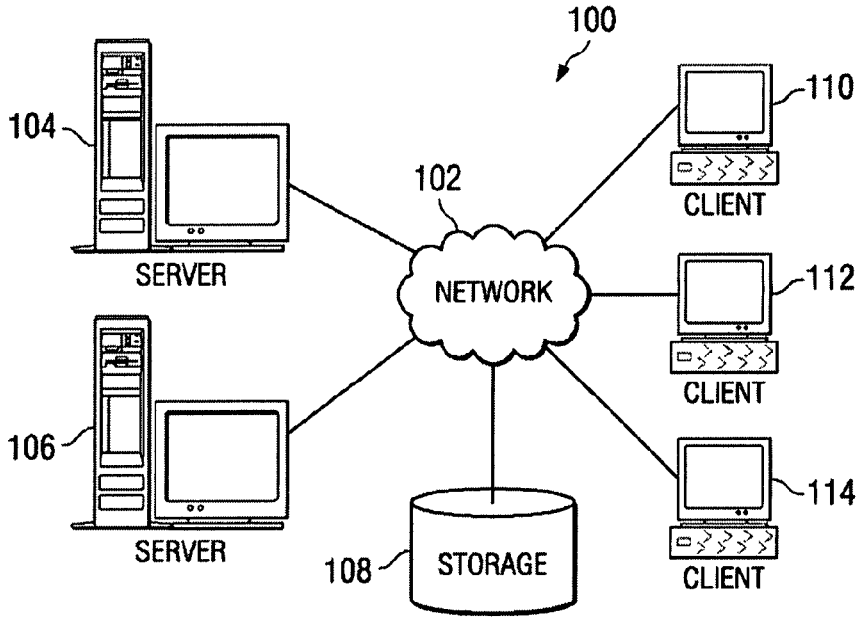
FIG. 1 is a pictorial representation of a network data processing system in which the illustrative embodiments may be implemented.
Figure 2:
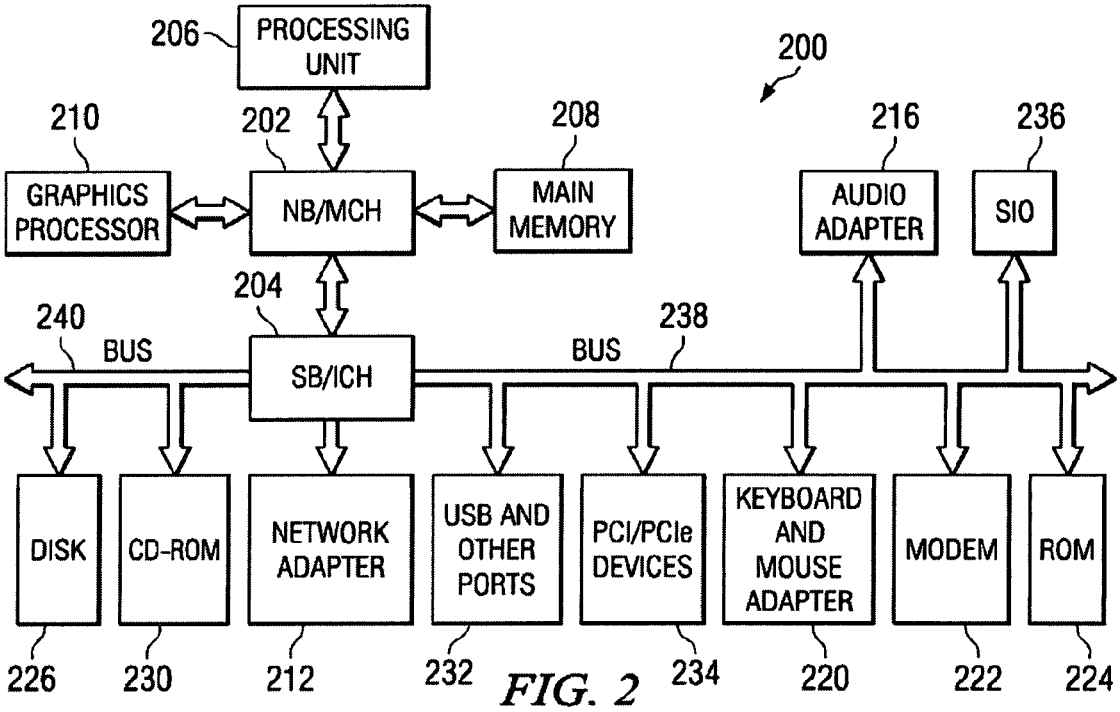
FIG. 2 is a block diagram of a data processing system in which the illustrative embodiments may be implemented.

With reference now to the figures and in particular with reference to FIGS. 1-2, exemplary diagrams of data processing environments are provided in which illustrative embodiments may be implemented. It should be appreciated that FIGS. 1-2 are only exemplary and are not intended to assert or imply any limitation with regard to the environments in which different embodiments may be implemented. Many modifications to the depicted environments may be made.

FIG. 1 depicts a pictorial representation of a network of data processing systems in which illustrative embodiments may be implemented. Network data processing system 100 is a network of computers in which the illustrative embodiments may be implemented. Network data processing system 100 contains network 102, which is the medium used to provide communications links between various devices and computers connected together within network data processing system 100. Network 102 may include connections, such as wire, wireless communication links, fiber optic cables, or differential transmission lines.

In the depicted example, server 104 and server 106 connect to network 102 along with storage unit 108. In addition, clients 110, 112, and 114 connect to network 102. Clients 110, 112, and 114 may be, for example, personal computers or network computers. In the depicted example, server 104 provides data, such as boot files, operating system images, and applications to clients 110, 112, and 114. Clients 110, 112, and 114 are clients to server 104 in this example. Clients 110, 112, and 114, servers 104 and 106, and storage 108 may be directly interconnected by differential transmission lines. Network data processing system 100 may include additional servers, clients, and other devices not shown.

In the depicted example, network data processing system 100 is the Internet with network 102 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, governmental, educational and other computer systems that route data and messages. Of course, network data processing system 100 also may be implemented as a number of different types of networks, such as for example, an intranet, a local area network (LAN), or a wide area network (WAN). FIG. 1 is intended as an example, and not as an architectural limitation for the different illustrative embodiments.

With reference now to FIG. 2, a block diagram of a data processing system is shown in which illustrative embodiments may be implemented. Data processing system 200 is an example of a computer, such as server 104 or client 110 in FIG. 1, in which computer-usable program code or instructions implementing the processes may be located for the illustrative embodiments.

In the depicted example, data processing system 200 employs a hub architecture including interface and memory controller hub (interface/MCH) 202 and interface and input/output (I/O) controller hub (interface/ICH) 204. Processing unit 206, main memory 208, and graphics processor 210 are coupled to interface and memory controller hub 202. Interface and memory controller hub 202 may implement differential signaling between processing unit 206, main memory 208, and graphics processor 210 using differential transmission lines. Processing unit 206 may contain one or more processors and even may be implemented using one or more heterogeneous processor systems. Graphics processor 210 may be coupled to the interface/MCH through an accelerated graphics port (AGP), for example.

In the depicted example, local area network (LAN) adapter 212 is coupled to interface and I/O controller hub 204 and audio adapter 216, keyboard and mouse adapter 220, modem 222, read only memory (ROM) 224, universal serial bus (USB) and other ports 232, and PCI/PCIe devices 234 are coupled to interface and I/O controller hub 204 through bus 238, and hard disk drive (HDD) 226 and CD-ROM 230 are coupled to interface and I/O controller hub 204 through bus 240. Busses 238 and 240 may include differential transmission lines to implement differential signaling between components of data processing system 200. PCI/PCIe devices may include, for example, Ethernet adapters, add-in cards, and PC cards for notebook computers. PCI uses a card bus controller, while PCIe does not. ROM 224 may be, for example, a flash binary input/output system (BIOS). Hard disk drive 226 and CD-ROM 230 may use, for example, an integrated drive electronics (IDE) or serial advanced technology attachment (SATA) interface. A super I/O (SIO) device 236 may be coupled to interface and I/O controller hub 204.

An operating system runs on processing unit 206 and coordinates and provides control of various components within data processing system 200 in FIG. 2. The operating system may be a commercially available operating system such as Microsoft® Windows Vista™ (Microsoft and Windows Vista are trademarks of Microsoft Corporation in the United States, other countries, or both). An object oriented programming system, such as the Java™ programming system, may run in conjunction with the operating system and provides calls to the operating system from Java™ programs or applications executing on data processing system 200. Java™ and all Java™-based trademarks are trademarks of Sun Microsystems, Inc. in the United States, other countries, or both.

Instructions for the operating system, the object-oriented programming system, and applications or programs are located on storage devices, such as hard disk drive 226, and may be loaded into main memory 208 for execution by processing unit 206. The processes of the illustrative embodiments may be performed by processing unit 206 using computer-implemented instructions, which may be located in a memory such as, for example, main memory 208, read only memory 224, or in one or more peripheral devices.

The hardware in FIGS. 1-2 may vary depending on the implementation. Other internal hardware or peripheral devices, such as flash memory, equivalent non-volatile memory, or optical disk drives and the like, may be used in addition to or in place of the hardware depicted in FIGS. 1-2. Also, the processes of the illustrative embodiments may be applied to a multiprocessor data processing system.

In some illustrative examples, data processing system 200 may be a personal digital assistant (PDA), which is generally configured with flash memory to provide non-volatile memory for storing operating system files and/or user-generated data. A bus system may be comprised of one or more buses, such as a system bus, an I/O bus and a PCI bus. Of course, the bus system may be implemented using any type of communications fabric or architecture that provides for a transfer of data between different components or devices attached to the fabric or architecture. For example, the bus system may implement differential signaling and include one or more differential transmission lines. A communications unit may include one or more devices used to transmit and receive data, such as a modem or a network adapter. A memory may be, for example, main memory 208 or a cache such as found in interface and memory controller hub 202. A processing unit may include one or more processors or CPUs. The depicted examples in FIGS. 1-2 and above-described examples are not meant to imply architectural limitations. For example, data processing system 200 also may be a tablet computer, laptop computer, or telephone device in addition to taking the form of a PDA.

The illustrative embodiments described herein provide an apparatus and method for facilitating signal transmission using differential transmission lines. In one embodiment, the apparatus includes a first differential transmission line. The first differential transmission line includes a first plurality of conductors. A conductor is any material capable of conducting electricity. The plurality of conductors includes a set of conductors. The set of conductors includes one or more conductors.

The apparatus also includes a second differential transmission line. The second differential transmission line includes a second plurality of conductors. The second plurality of conductors includes a first conductor and a second conductor.

A first noise produced by the first conductor on the set of conductors is balanced by a second noise produced by the second conductor on the set of conductors. A noise is any effect on the set of conductors caused by at least one of the second plurality of conductors. For example, a noise may be a voltage aberration on the set of conductors caused by at least one of the second plurality of conductors.

The first noise and the second noise are "balanced" if the first noise and second noise cause no change in the original signal carried by the first differential transmission line that would change a device's interpretation of the original signal. As used in these examples, an interpretation is any meaning or representation attributed to the original signal. The device is any device capable of detecting a difference between two conductors in a differential transmission line, such as an oscilloscope, bit error rate tester, or differential receiver circuit. In another embodiment, the first noise and the second noise are "balanced" if a signal carried by the first differential transmission line is changed by less than a predefined threshold amount.

In an alternate embodiment, the first noise produced by the first conductor on all of the first plurality of conductors is balanced by the second noise produced by the second conductor on all of the first plurality of conductors. In another embodiment, the first noise is cancelled by the second noise.

In another embodiment, the first noise produced by the first conductor on the set of conductors is balanced by the second noise produced by the second conductor on the set of conductors if a negligible amount of net noise is produced by the first conductor and the second conductor on the set of conductors. Net noise is the cumulative effect of the first noise and the second noise on the set of conductors. A negligible amount of net noise is an amount of net noise that causes no change in the original signal carried by the first differential transmission line that would change a device's interpretation of the original signal. In another embodiment, a negligible amount of net noise is a predefined threshold amount of noise. In one example, the negligible amount of net noise is zero.

In another embodiment, the first plurality of conductors defines a first axis and the second plurality of conductors defines a second axis. In this embodiment, the first axis forms an angle with the second axis. In one example, the angle is approximately ninety degrees. "Approximately" means that the angle's deviation from ninety degrees is too slight to cause a change in a device's interpretation of the original signal carried by the first differential transmission line. In another example, "approximately" means that the angle's deviation from ninety degree is less than a predefined threshold amount.

In another embodiment, the second axis is substantially perpendicular to the first axis. "Substantially" means that the second axis' deviation from being perpendicular to the first axis is too slight to cause a change in a device's interpretation of the original signal carried by the first differential transmission line. In another example, "substantially" means that the second axis' deviation from being perpendicular is less than a predefined threshold amount. Also, in this embodiment, the second differential transmission line may be located along a line of symmetry. The line of symmetry dissects the first axis. For example, the line of symmetry may occur at a midpoint of the first axis.

In another embodiment, the first differential transmission line comprises a plurality of first differential transmission lines and the second differential transmission line comprises a plurality of second differential transmission lines. In this embodiment, the plurality of first differential transmission lines and the plurality of second differential transmission lines may be arranged in a staggered pattern or a grid pattern. The staggered pattern and grid pattern are discussed in further details with the respect to FIGS. 5-8 below.

Figure 3:
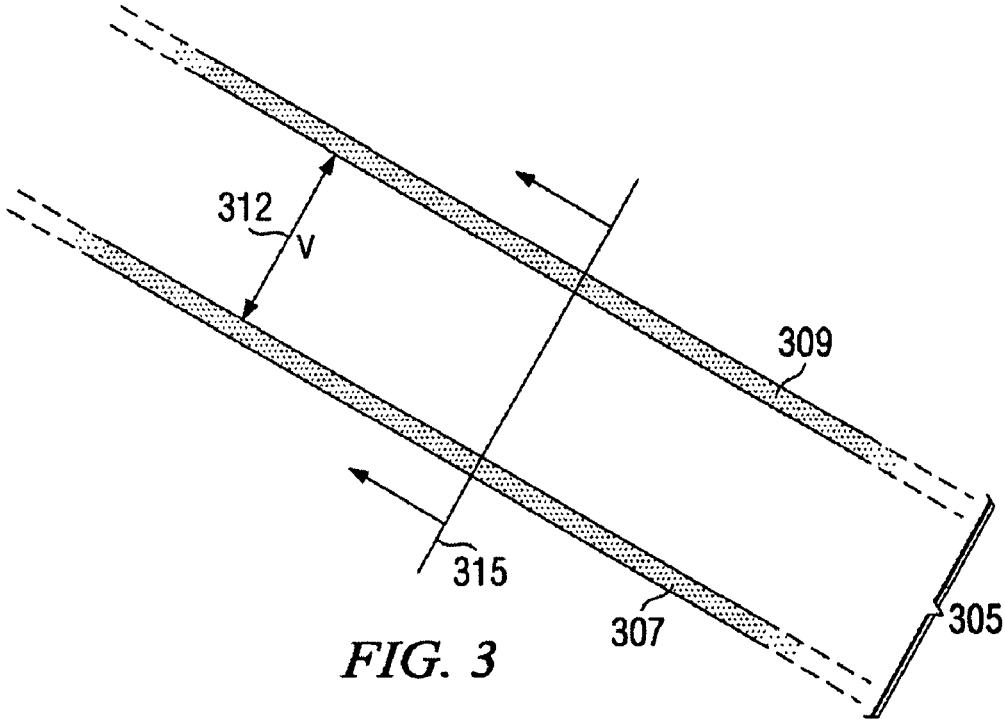
FIG. 3 is a perspective view of differential transmission lines.

Turning now to FIG. 3, a perspective view of a differential transmission line is shown. Specifically, FIG. 3 shows differential transmission line 305, which may be implemented in accordance with the illustrative embodiments.

Differential transmission line 305 includes conductors 307 and 309. Conductors 307 and 309 may also be referred to as a "trace" or a "phase" of differential transmission line 305. Conductors 307 and 309 may be composed of any conductive material. For example, conductors 307 and 309 may be composed of copper, silver, aluminum, gold, nickel, molybdenum, tungsten, or any combination thereof.

Conductors 307 and 309 may have any shape. As shown in FIG. 3, conductors 307 and 309 have a circular cross-sectional shape. However, conductors 307 and 309 may also have a cross-sectional shape that is a square, rectangle, ellipse, triangle, or any polygon.

Differential transmission line 305 transmits a signal. In one non-limiting example, the signal may be obtained by measuring voltage difference 312 between conductors 307 and 309. In this example, voltage difference 312 may be measured by any device, such as an oscilloscope, bit error rate tester, or differential receiver circuit.

In one non-limiting example of a signal that may be transmitted by differential transmission line 305, differential transmission line 305 may transmit either a high-logic state signal, such as "1", or low-logic state signal, such as "0". A high-logic state signal, in one example, may be present when conductor 307 has a predefined non-zero voltage $V_s$ and conductor 309 has a voltage of zero. A low-logic state signal, in one example, may be present when conductor 307 has a voltage of zero and conductor 309 has a predefined non-zero voltage $V_s$. Differential transmission line 305 may be used to send any type of signal, which may be obtained or interpreted by measuring voltage difference 312. Non-limiting examples of signals that may be transmitted include digital logic signals, analog baseband signals, or modulated carrier signals. Examples of modulated carrier signals include, among others, frequency modulated signals, amplitude modulated signals, phase modulated signals, and single sideband signals.

Noise may be introduced onto any of conductors 307 and 309 by any outside source capable of producing electromagnetic emissions, such as other differential transmission lines. In the case in which differential transmission line 305 transmits a high-logic state signal or low-logic state signal, the presence of another differential transmission line may introduce noise onto any one of conductors 307 and 309. In fact, the presence of another differential transmission line threatens the integrity of the original signal transmitted by differential transmission line 305. For example, because the voltage difference between the high-logic state and the low-logic state is $V_s$ times two ($2V_s$), any noise caused by the presence of another differential transmission line that exceeds $2V_s$ results in a changed interpretation of the original signal by any device measuring the voltage difference 312. In a more specific example, in the case in which differential transmission line 305 transmits a low-logic state signal, a noise that is greater than $2V_s$ on either or both of conductors 307 and 309 may result in the failure of a measuring device to interpret voltage difference 312 as a low-logic state signal.

In another example, conductors 307 and 309 may be balanced or unbalanced lines. In the example in which conductors 307 and 309 are balanced lines, each of conductors 307 and 309 have equal impedance to ground or other circuits. A balanced line reduces noise on conductors 307 and 309 by rejecting common-mode interference.

Figure 4:
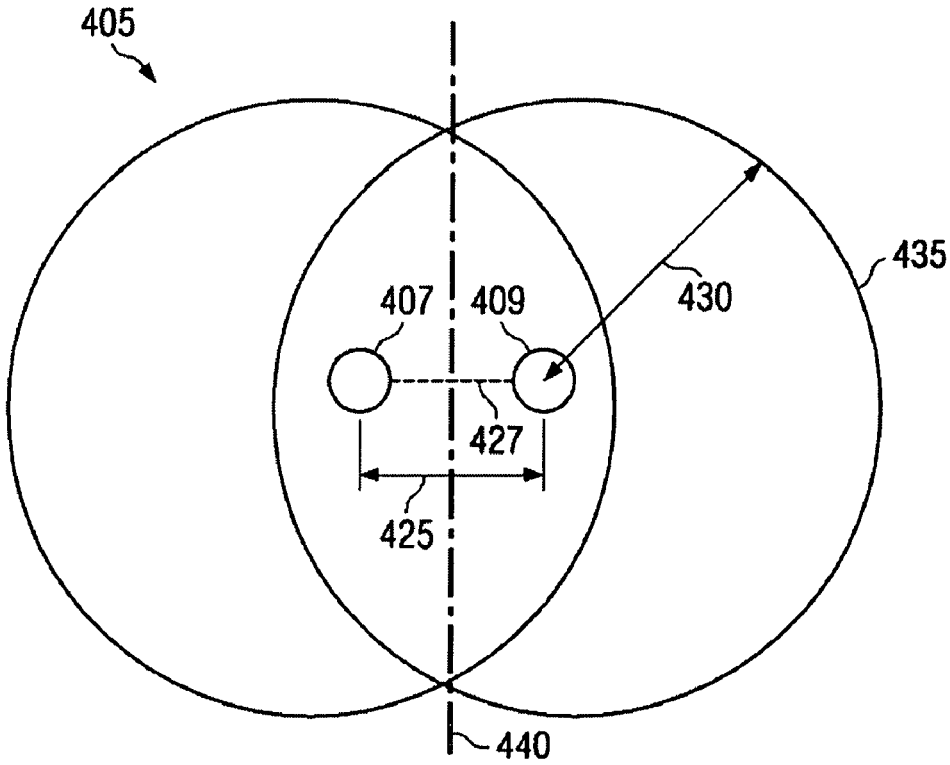
FIG. 4 is a cross-sectional view of a differential transmission line on which the illustrative embodiments may be implemented.

Turning now to FIG. 4, a cross-sectional view of a differential transmission line on which the illustrative embodiments may be implemented is shown. Specifically, FIG. 4 shows a cross-sectional view of differential transmission line 305 in FIG. 3 as indicated by cross-sectional line 315.

Differential transmission line 405 includes conductors 407 and 409, which are separated by distance 425. Conductors 407 and 409 define axis 427, which is the shortest distance connecting conductors 407 and 409.

FIG. 4 also shows isolation distance 430. Isolation distance is the smallest distance between conductor 409 and another electromagnetic source, such as another differential transmission line, at which a negligible amount of noise is introduced on conductor 409. Hence, if a conductor from another differential transmission line is present in area 435, non-negligible amounts of noise will be introduced onto conductor 409. In one embodiment, isolation distance 430 is larger than distance 425 such that the noise coupling is minimized between conductors 407 and 409.

Line of symmetry 440 dissects axis 427. Line of symmetry 440 is also perpendicular to axis 427. Line of symmetry 440 may intersect axis 427 at the midpoint of axis 427. Alternatively, line of symmetry 440 may intersect axis 427 at any point along axis 427.

In one example, external signal induction that equally affects conductors 407 and 409 will be rejected. Hence, one or more signal traces, conductors, pins, or vias that are positioned along line of symmetry 440 will be at the same distance from both of conductors 407 and 409, and will induce the same amount of noise on each of conductors 407 and 409. Thus, the induced noise will be ignored.

Figure 5:
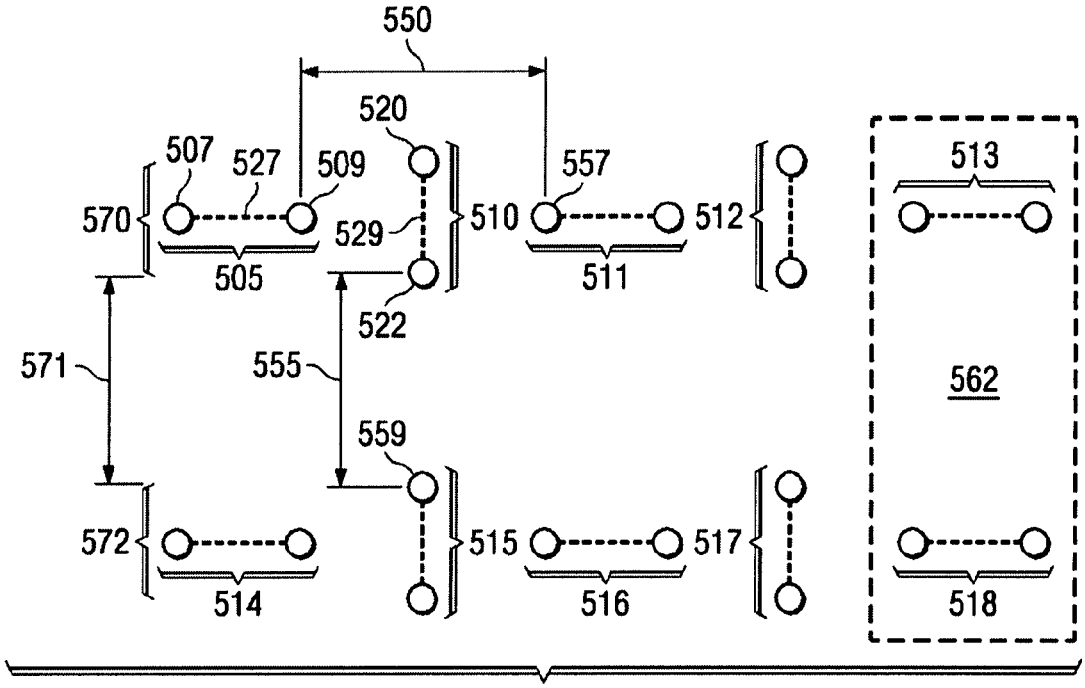
FIG. 5 is a cross-sectional view of differential transmission lines for facilitating signal transmission in accordance with an illustrative embodiment.

Turning now to FIG. 5, a cross-sectional view of differential transmission lines for facilitating signal transmission is shown in accordance with an illustrative embodiment. Specifically, FIG. 5 shows differential transmission lines 505, 510, 511, 512, 513, 514, 515, 516, 517, and 518 in a grid pattern. One or more signals may be transmitted using differential transmission lines 505, 510, 511, 512, 513, 514, 515, 516, 517, and 518. Differential transmission lines 505, 510, 511, 512, 513, 514, 515, 516, 517, and 518 are non-limiting examples of differential transmission line 305 in FIG. 3 and differential transmission line 405 in FIG. 4, including extensions of axis 427 beyond conductors 407 and 409.

In FIG. 5, differential transmission line 505 includes conductors 507 and 509. Conductors 507 and 509 define axis 527. Differential transmission line 510 includes conductors 520 and 522.

In one embodiment, a first noise produced by conductor 520 on conductor 507 is balanced by a second noise produced by conductor 522 on conductor 507. Similarly, a first noise produced by conductor 520 on conductor 509 is balanced by a second noise produced by conductor 522 on conductor 509. The first noise and the second noise are "balanced" if the first noise and second noise cause no change in a signal carried by differential transmission line 505 that would change a device's interpretation of the signal. An interpretation is any meaning or representation attributed to the signal. For example, assuming that a device interprets a voltage differential of six volts as a '1', in the case in which the differential transmission line 505 has a voltage differential of six volts, the first noise and the second noise are balanced if the device interprets the voltage differential as a '1'. In this example, if the device interprets the voltage differential as anything other than '1', such as '0', then the first noise and the second noise are unbalanced.

In another embodiment, the first noise produced by conductor 520 on both of conductors 507 and 509 is balanced by the second noise produced by conductor 522 on both of conductors 507 and 509. In one embodiment, the first noise is cancelled by the second noise.

In another embodiment, a negligible amount of net noise is produced by conductors 520 and 522 on either or both of conductors 507 or 509. For example, the negligible amount of net noise on either or both of conductors 507 or 509 may be zero or approximately zero.

In another embodiment, conductors 520 and 522 of differential transmission line 510 define axis 529. In this embodiment, axis 529 is perpendicular to axis 527. In another embodiment, the direction along which axis 529 lies is oriented approximately ninety degrees from the direction along which axis 527 lies. In another embodiment, axis 527 has a horizontal orientation and axis 529 has a vertical orientation.

As shown in FIG. 5, a line as defined by axis 527 intersects axis 529 at the midpoint of axis 529. Also, conductors 520 and 522 are equidistant from each of conductors 507 and 509. In one example, as a result of such equidistance, no net noise is produced on either of conductors 507 and 509.

In FIG. 5, differential transmission line 510 is not positioned between conductors 507 and 509. However, additional illustrative embodiments in which differential transmission line 510 is positioned between conductors 507 and 509 will be discussed in greater detail with respect to FIGS. 7 and 8.

Differential transmission lines 505, 511, 513, 514, 516, and 518 each have the same orientation because each of these differential transmission lines have axes that lie in the same directional plane. Conductor 509 is isolation distance 550 from conductor 557 in differential transmission line 511. In one embodiment, each conductor in each of differential transmission lines 505, 511, 513, 514, 516, and 518 is at least an isolation distance away from another conductor in a different one of differential transmission lines 505, 511, 513, 514, 516, and 518. By positioning conductor 557 isolation distance 550 away from conductor 509, noise on conductor 509 is minimized, thereby maintaining the integrity of a signal on differential transmission line 505.

Similarly, differential transmission lines 510, 512, 515, and 517 each have the same orientation because each of these differential transmission lines have axes that lie in the same directional plane. Conductor 522 is isolation distance 555 from conductor 559 in differential transmission line 515. In one embodiment, each conductor in each of differential transmission lines 510, 512, 515, and 517 is at least an isolation distance away from another conductor in a different one of differential transmission lines 510, 512, 515, and 517. By positioning conductor 522 isolation distance 555 away from conductor 559, noise on conductor 522 is minimized, thereby maintaining the integrity of a signal on differential transmission line 510.

In another embodiment, differential transmission lines 505, 510, 511, 512, 513, 514, 515, 516, 517, and 518 facilitate signal transmission using vias. A via is a plated hole that connects conductors from one layer of a circuit board to conductors from another layer of the circuit board. Alternatively, differential transmission lines 505, 510, 511, 512, 513, 514, 515, 516, 517, and 518 may be used to facilitate signal transmission between any components of a circuit board.

In another embodiment, differential transmission lines 505, 510, 511, 512, 513, 514, 515, 516, 517, and 518 facilitate signal transmission in a pin arrangement. Pins are connecting interfaces between computing devices. For examples, plug-in connectors for computers often include pin arrangements, which facilitate communication to and from an external device.

Differential transmission lines 505, 510, 511, 512, 513, 514, 515, 516, 517, and 518 are in a grid pattern. In a grid pattern or arrangement, each column of differential transmission lines includes differential transmission lines having the same orientation. For example, in FIG. 5, differential transmission lines 513 and 518 in column 562 have the same orientation. The same holds true for the other columns in FIG. 5.

Figure 6:
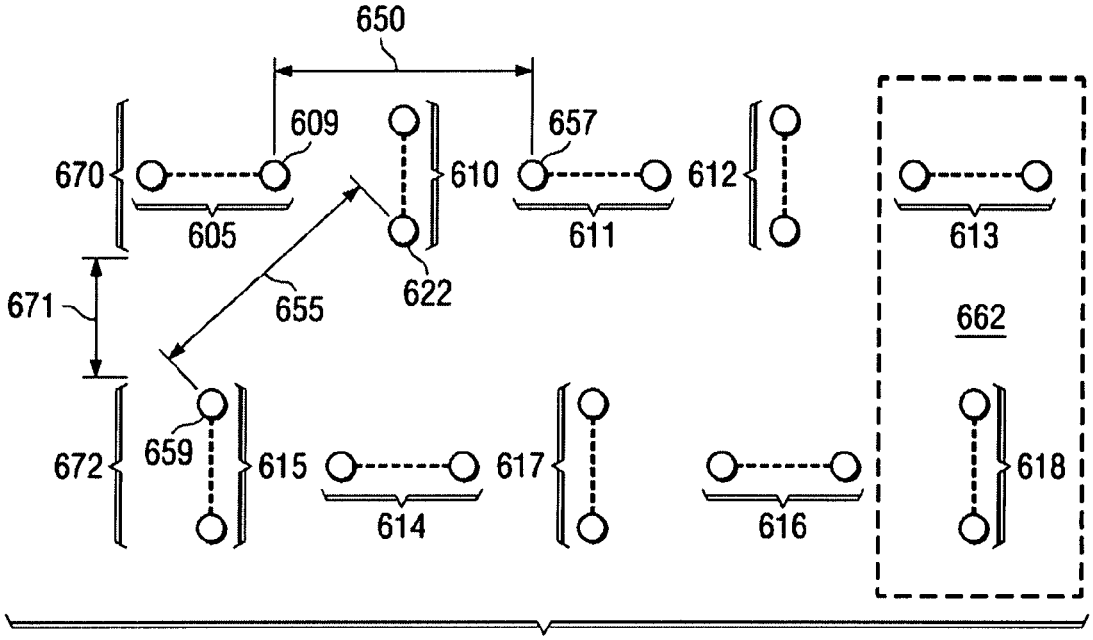
FIG. 6 is a cross-sectional view of differential transmission lines for facilitating signal transmission in accordance with an illustrative embodiment.

Turning now to FIG. 6, a cross-sectional view of differential transmission lines for facilitating signal transmission is depicted in accordance with an illustrative embodiment. Specifically, FIG. 6 shows differential transmission lines 605, 610, 611, 612, 613, 614, 615, 616, 617, and 618 in a staggered pattern. One or more signals may be transmitted using differential transmission lines 605, 610, 611, 612, 613, 614, 615, 616, 617, and 618. Differential transmission lines 605, 610, 611, 612, 613, 614, 615, 616, 617, and 618 are non-limiting examples of differential transmission line 305 in FIG. 3 and differential transmission line 405 in FIG. 4.

Differential transmission lines 605, 611, 613, 614, and 616 each have the same orientation because each of these differential transmission lines have axes that lie in the same directional plane. Conductor 609 is isolation distance 650 from conductor 657 in differential transmission line 611. In one embodiment, each conductor in each of differential transmission lines 605, 611, 613, 614, and 616 is at least an isolation distance away from another conductor in a different one of differential transmission lines 605, 611, 613, 614, and 616. By positioning conductor 657 isolation distance 650 away from conductor 609, noise on conductor 609 is minimized, thereby maintaining the integrity of a signal on differential transmission line 605.

Similarly, differential transmission lines 610, 612, 615, 617, and 618 each have the same orientation because each of these differential transmission lines have axes that lie in the same directional plane. Conductor 622 is isolation distance 655 away from conductor 659 in differential transmission line 615. In one embodiment, each conductor in each of differential transmission lines 610, 612, 615, 617, and 618 is at least an isolation distance away from another conductor in a different one of differential transmission lines 610, 612, 615, 617, and 618. By positioning conductor 622 isolation distance 655 away from conductor 659, noise on conductor 622 is minimized, thereby maintaining the integrity of a signal on differential transmission line 610.

In the illustrative embodiment of FIG. 6, differential transmission lines 605, 610, 611, 612, 613, 614, 615, 616, 617, and 618 are in a staggered pattern. In a staggered pattern, each successive row in each column of differential transmission lines has either a differential transmission line with a different orientation or no differential transmission line at all. For example, in FIG. 6, differential transmission lines 613 and 618 in column 662 have a different orientation. The same holds true for the other columns in FIG. 6.

A staggered pattern of differential transmission lines, such as that in FIG. 6, may allow for an increased density of differential transmission lines per unit area. Specifically, because isolation distance 655 is measured between conductors in different columns, distance 671 between rows 670 and 672 may be shorter than distance 571 between rows 570 and 572 in FIG. 5. Thus, a greater density of differential transmission lines may be achieved.

Figure 7:
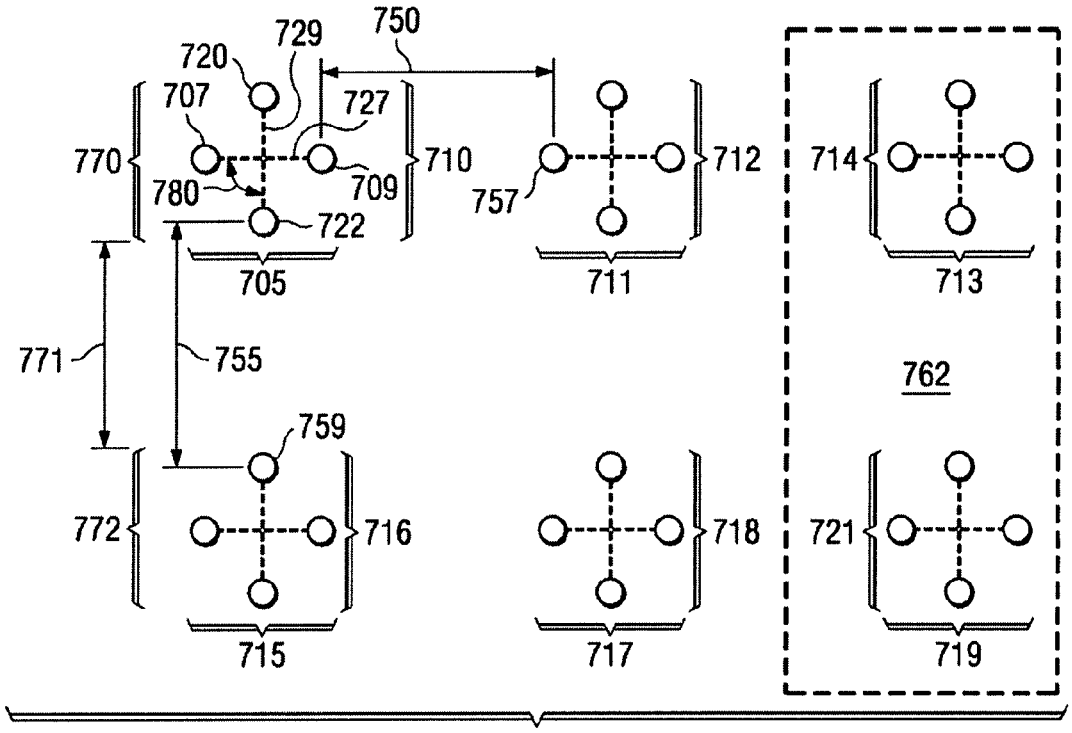
FIG. 7 is a cross-sectional view of differential transmission lines for facilitating signal transmission in accordance with an illustrative embodiment.

Turning now to FIG. 7, a cross-sectional view of differential transmission lines for facilitating signal transmission is shown in accordance with an illustrative embodiment. Specifically, FIG. 7 shows differential transmission lines 705, 710, 711, 712, 713, 714, 715, 716, 717, 718, 719, and 721 in a grid pattern. One or more signals may be transmitted using differential transmission lines 705, 710, 711, 712, 713, 714, 715, 716, 717, 718, 719, and 721. Differential transmission lines 705, 710, 711, 712, 713, 714, 715, 716, 717, 718, 719, and 721 are non-limiting examples of differential transmission line 305 in FIG. 3 and differential transmission line 405 in FIG. 4.

Conductors 707 and 709 of differential transmission line 705 define axis 727. Conductors 720 and 722 of differential transmission line 710 define axis 729. Axis 729 is substantially perpendicular to axis 727.

In one embodiment, axis 729 forms angle 780 with axis 727. In this embodiment, angle 780 may be ninety degrees. In another embodiment, angle 780 may be any angle that fails to cause a change in the original signal carried by differential transmission line 705 that would change a device's interpretation of the original signal.

In FIG. 7, differential transmission line 710 is located along the line of symmetry of differential transmission line 705. In one embodiment, the line of symmetry of differential transmission line 705 dissects axis 727 at the midpoint of axis 727. However, the line of symmetry of differential transmission line 705 may dissect axis 727 at any point of axis 727.

The net noise on conductor 707 matches the net noise on conductor 709. In one embodiment, because conductors 720 and 722 are located at the same distance from both of conductors 707 and 709, conductors 720 and 722 produce the same amount of noise on each of conductors 707 and 709. Because each conductor 707 and 709 is affected equally, the noise will be ignored during a differential signal measurement.

Differential transmission lines 705, 711, 713, 715, 717, and 719 each have the same orientation because each of these differential transmission lines have axes that lie in the same directional plane. Conductor 709 is isolation distance 750 from conductor 757 in differential transmission line 711. In one embodiment, each conductor in each of differential transmission lines 705, 711, 713, 715, 717, and 719 is at least an isolation distance away from another conductor in a different one of differential transmission lines 705, 711, 713, 715, 717, and 719. By positioning conductor 757 isolation distance 750 away from conductor 709, noise on conductor 709 is minimized, thereby maintaining the integrity of a signal on differential transmission line 705.

Similarly, differential transmission lines 710, 712, 714, 716, 718, and 721 each have the same orientation because each of these differential transmission lines have axes that lie in the same directional plane. Conductor 722 is isolation distance 755 from conductor 759 in differential transmission line 716. In one embodiment, each conductor in each of differential transmission lines 710, 712, 714, 716, 718, and 721 are at least an isolation distance away from another conductor in a different one of differential transmission lines 710, 712, 714, 716, 718, and 721. By positioning conductor 722 isolation distance 755 away from conductor 759, noise on conductor 722 is minimized, thereby maintaining the integrity of a signal on differential transmission line 710.

Differential transmission lines 705, 710, 711, 712, 713, 714, 715, 716, 717, 718, 719, and 721 are in a grid pattern. In a grid pattern or arrangement, each column of differential transmission lines includes differential transmission lines having the same orientation. For example, in FIG. 7, differential transmission lines 713 and 714 and differential transmission lines 719 and 721 in column 762 have the same orientation. The same holds true for the other columns in FIG. 7.

Figure 8:
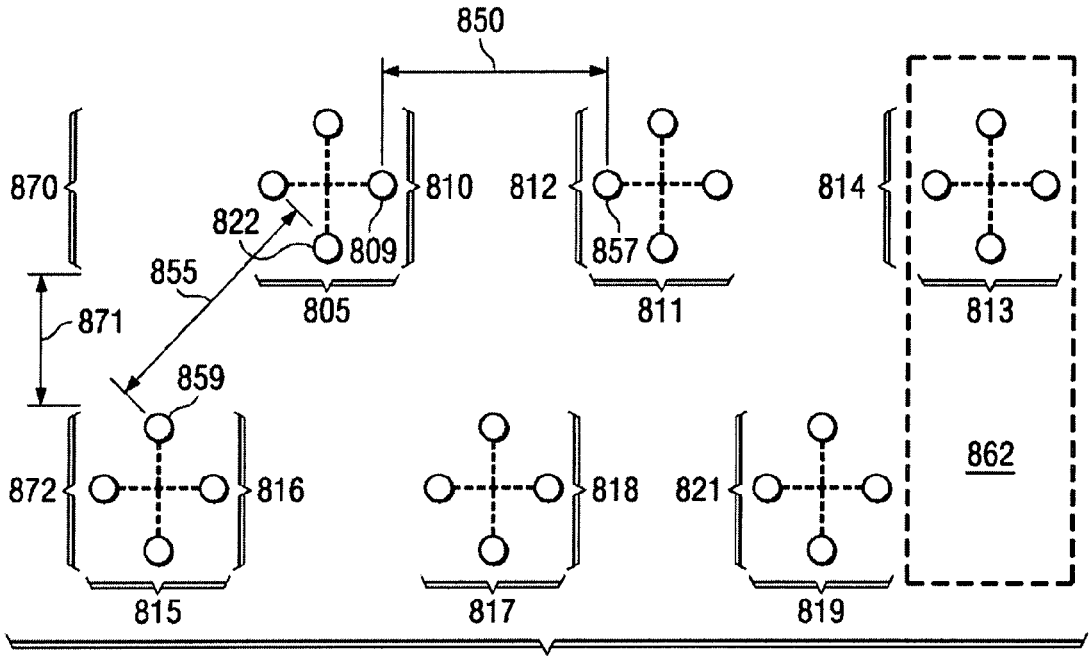
FIG. 8 is a cross-sectional view of differential transmission lines for facilitating signal transmission in accordance with an illustrative embodiment.

Turning now to FIG. 8, a cross-sectional view of differential transmission lines for facilitating signal transmission is shown in accordance with an illustrative embodiment. Specifically, FIG. 8 shows differential transmission lines 805, 810, 811, 812, 813, 814, 815, 816, 817, 818, 819, and 821 in a staggered pattern. One or more signals may be transmitted using differential transmission lines 805, 810, 811, 812, 813, 814, 815, 816, 817, 818, 819, and 821. Differential transmission lines 805, 810, 811, 812, 813, 814, 815, 816, 817, 818, 819, and 821 are non-limiting examples of differential transmission line 305 in FIG. 3 and differential transmission line 405 in FIG. 4.

Differential transmission lines 805, 811, 813, 815, 817, and 819 each have the same orientation because each of these differential transmission lines have axes that lie in the same directional plane. Conductor 809 is isolation distance 850 from conductor 857 in differential transmission line 811. In one embodiment, each conductor in each of differential transmission lines 805, 811, 813, 815, 817, and 819 is at least an isolation distance away from another conductor in a different one of differential transmission lines 805, 811, 813, 815, 817, and 819. By positioning conductor 857 isolation distance 850 away from conductor 809, noise on conductor 809 is minimized, thereby maintaining the integrity of a signal on differential transmission line 805.

Similarly, differential transmission lines 810, 812, 814, 816, 818, and 821 each have the same orientation because each of these differential transmission lines have axes that lie in the same directional plane. Conductor 822 is isolation distance 855 away from conductor 859 in differential transmission line 816. In one embodiment, each conductor in each of differential transmission lines 810, 812, 814, 816, 818, and 821 are at least an isolation distance away from another conductor in a different one of differential transmission lines 810, 812, 814, 816, 818, and 821. By positioning conductor 822 isolation distance 855 away from conductor 859, noise on conductor 822 is minimized, thereby maintaining the integrity of a signal on differential transmission line 810.

In the illustrative embodiment of FIG. 8, differential transmission lines 805, 810, 811, 812, 813, 814, 815, 816, 817, 818, 819, and 821 are in a staggered pattern. In a staggered pattern, each successive row in each column of differential transmission lines has either a differential transmission line with a different orientation or no differential transmission line at all. For example, row 870 of column 862 contains differential transmission lines 813 and 814, and row 872 of column 862 contains no differential transmission lines at all. The other columns in FIG. 8 have such an alternating pattern.

A staggered pattern of differential transmission lines, such as that in FIG. 8, may allow for an increased density of differential transmission lines per unit area. Specifically, because isolation distance 855 is measured between conductors in different columns, distance 871 between rows 870 and 872 may be shorter than distance 771 between rows 770 and 772 in FIG. 7. Thus, a greater density of differential transmission lines may be achieved.

The illustrative embodiments show differential transmission lines that facilitate signal transmission and increase the density of the differential transmission lines for a particular area. Normally, when multiple differential transmission lines are wired together, typically as part of a high-speed bus, the differential transmission lines need to be spaced apart from each other in order to minimize inter-signal noise coupling. However, an external voltage noise induced equally among two conductor of a differential transmission line will be ignored during differential signal measurement, as the noise will have the same magnitude and phase in the two conductors. The non-limiting configurations shown in the illustrative embodiment are examples of how to balance noise such that the noise will be ignored or rejected.

Pair to pair isolation is also needed when the differential transmission lines go through non-planar structures. Non-planar structures are structures in which power planes are not present, such as via connections or component pins. A considerable amount of space is needed to arrange a via or pin field when multiple signal pairs are involved. The need for such space arises from the need to provide sufficient separation between pairs in all directions in order to minimize signal coupling among pairs. This results in larger components than needed and inefficient utilization of card wiring resources, and large timing differences between the signals.

The illustrative embodiments, and their exemplary use in vias and pin arrangements, maximize the number of differential transmission lines per unit area, while maintaining the required pair-to-pair isolation level. This is achieved by using the common noise rejection properties of differential signals.

Thus, the illustrative embodiments minimize the space needed for differential transmission lines, thereby resulting in the more efficient use of hardware and time. For example, be being able to place more differential transmission lines per unit area, smaller and less expensive components are needed. Also, more signals may be transmitted for a given component size or a given amount of available card real estate.

Figure 9:
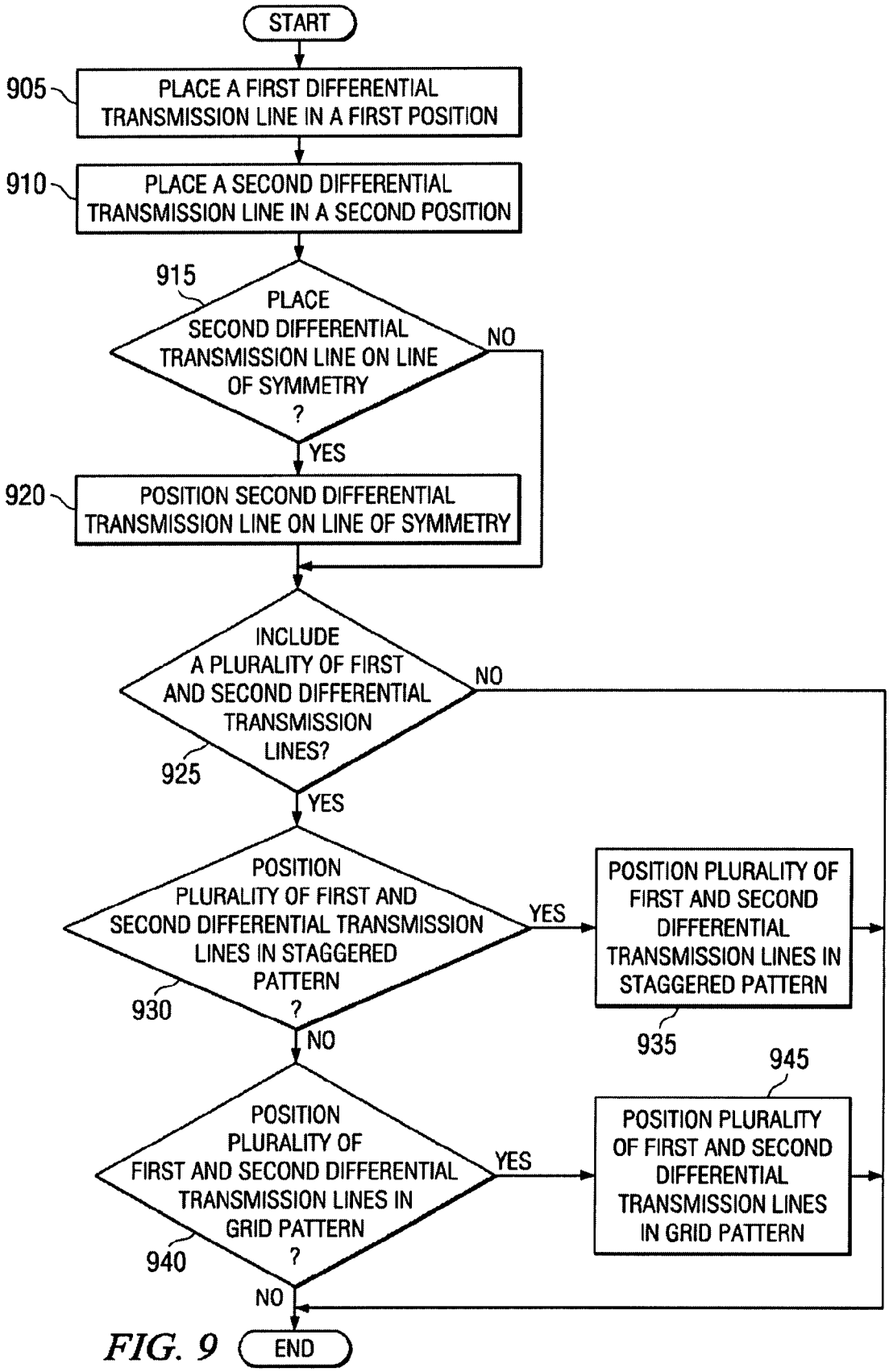
FIG. 9 is a flowchart illustrating a process for facilitating signal transmission using differential transmission lines in accordance with an illustrative embodiment.

Turning now to FIG. 9, a flowchart illustrating a process for facilitating signal transmission using differential transmission lines in accordance with an illustrative embodiment. The process illustrated in FIG. 9 may be performed on a circuit or computer parts manufacturer or any entity that assembles or works with differential transmission lines.

The process begins by placing a first differential transmission line in a first position (step 905). The process places a second differential transmission line in a second position (step 910). When the second differential transmission line is in the second position, a first noise produced by a first conductor in the second differential transmission line on a particular conductor in the first differential transmission line is balanced by a second noise produced by a second conductor in the second differential transmission line on the particular conductor in the first differential transmission line.

The process determines whether to place the second differential transmission line on a line of symmetry dissecting an axis defined by the first second differential transmission line (step 915). If the process determines not to place the second differential transmission line on a line of symmetry dissecting an axis defined by the first second differential transmission line, then the process proceeds to step 925. Returning to step 915, if the process determines to place the second differential transmission line on a line of symmetry dissecting an axis defined by the first second differential transmission line, then the process places the second differential transmission line on a line of symmetry dissecting an axis defined by the first second differential transmission line (step 920).

The process determines whether to include a plurality of first and second differential transmission lines in the arrangement of first and second differential transmission lines (step 925). If the process determines not to include a plurality of first and second differential transmission lines in the arrangement of first and second differential transmission lines, the process terminates.

Returning to step 925, if the process determines to include a plurality of first and second differential transmission lines in the arrangement of first and second differential transmission lines, the process determines whether to position the plurality of first and second differential transmission lines in a staggered pattern (step 930). If the process determines to position the plurality of first and second differential transmission lines in a staggered pattern, then the process positions the plurality of first and second differential transmission lines in a staggered pattern (step 935). The process then terminates.

Returning to step 930, if the process determines not to position the plurality of first and second differential transmission lines in a staggered pattern, then the process determines whether to position the plurality of first and second differential transmission lines in a grid pattern (step 940). If the process determines to position the plurality of first and second differential transmission lines in a grid pattern, then the process positions the plurality of first and second differential transmission lines in a grid pattern (step 945). The process then terminates. Returning to step 940, if the process determines not to position the plurality of first and second differential transmission lines in a grid pattern, the process then terminates.

The flowcharts and block diagrams in the different depicted embodiments illustrate the architecture, functionality, and operation of some possible implementations of apparatus, methods and computer program products. In this regard, each block in the flowchart or block diagrams may represent a module, segment, or portion of code, which comprises one or more executable instructions for implementing the specified function or functions. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

The illustrative embodiments described herein provide an apparatus and method for facilitating signal transmission using differential transmission lines. In one embodiment, the apparatus includes a first differential transmission line. The first differential transmission line includes a first plurality of conductors. The plurality of conductors includes a set of conductors.

The apparatus also includes a second differential transmission line. The second differential transmission line includes a second plurality of conductors. The second plurality of conductors includes a first conductor and a second conductor.

A first noise produced by the first conductor on the set of conductors is balanced by a second noise produced by the second conductor on the set of conductors. In an alternate embodiment, the first noise produced by the first conductor on all of the first plurality of conductors is balanced by the second noise produced by the second conductor on all of the first plurality of conductors. In another embodiment, the first noise is cancelled by the second noise.

In another embodiment, the first noise produced by the first conductor on the set of conductors is balanced by the second noise produced by the second conductor on the set of conductors if a negligible amount of net noise is produced by the first conductor and the second conductor on the set of conductors. In one example, the negligible amount of net noise is zero.

In another embodiment, the first plurality of conductors defines a first axis and the second plurality of conductors defines a second axis. In this embodiment, the first axis forms an angle with the second axis. In one example, the angle is approximately ninety degrees. In another embodiment, the second axis is substantially perpendicular to the first axis. In this embodiment, the second differential transmission line may be located along a line of symmetry. The line of symmetry dissects the first axis. For example, the line of symmetry may occur at a midpoint of the first axis.

In another embodiment, the first differential transmission line comprises a plurality of first differential transmission lines and the second differential transmission line comprises a plurality of second differential transmission lines. In this embodiment, the plurality of first differential transmission lines and the plurality of second differential transmission lines may be arranged in a staggered pattern or a grid pattern.

The illustrative embodiments, as described above, may be part of the design for an integrated circuit chip. The chip design is created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer transmits the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus for facilitating signal transmission using differential transmission lines, comprising:

a first differential transmission line comprising a first plurality of conductors, wherein the first plurality of conductors comprises a pair of conductors, wherein the conductors of the pair of conductors are separated by a first distance;

a second differential transmission line comprising a second plurality of conductors, wherein the second plurality of conductors comprise a first conductor and a second conductor, wherein the first conductor and the second conductor are at least a first isolation distance away from all of the first plurality of conductors, wherein the first isolation distance is larger than the first distance, wherein a first noise produced by the first conductor on the pair of conductors is balanced by a second noise produced by the second conductor on the pair of conductors in response to the first isolation distance being larger than the first distance, wherein the first differential transmission line and the second differential transmission line facilitate signal transmission, wherein the first plurality of conductors define a first axis, wherein the second plurality of conductors define a second axis, and wherein the second axis is substantially perpendicular to the first axis; and an additional differential transmission line comprising an additional plurality of conductors that define an additional axis, wherein the additional plurality of conductors comprises an additional pair of conductors, wherein the conductors of the additional pair of conductors are separated by a second distance, wherein the first axis has a same orientation as the additional axis, and wherein the first conductor and the second conductor are at least a second isolation distance away from all of the additional plurality of conductors, wherein the second isolation distance is larger than the second distance, wherein a first additional noise produced by the first conductor on the additional pair of conductors is balanced by a second additional noise produced by the second conductor on the additional pair of conductors in response to the second isolation distance being larger than the second distance.

2. The apparatus of claim 1, wherein the first noise produced by the first conductor on all of the first plurality of conductors is balanced by the second noise produced by the second conductor on all of the first plurality of conductors.

3. The apparatus of claim 1, wherein the first noise is cancelled by the second noise.

4. The apparatus of claim 1, wherein a negligible amount of net noise is produced by the first conductor and the second conductor on the pair of conductors.

5. The apparatus of claim 1, wherein the second differential transmission line is located along a line of symmetry, wherein the line of symmetry dissects the first axis at a midpoint of the first axis.

6. The apparatus of claim 1, wherein the first differential transmission line and the second differential transmission line facilitate signal transmission in one of a via or a pin arrangement.

7. The apparatus of claim 1, wherein the first differential transmission line comprises a plurality of first differential transmission lines, wherein the second differential transmission line comprises a plurality of second differential transmission lines, and wherein the plurality of first differential transmission lines and the plurality of second differential transmission lines are arranged in a staggered pattern.

8. The apparatus of claim 1, wherein the first differential transmission line comprises a plurality of first differential transmission lines, wherein the second differential transmission line comprises a plurality of second differential transmission lines, and wherein the plurality of first differential transmission lines and the plurality of second differential transmission lines are arranged in a grid pattern.

9. The apparatus of claim 1, further comprising:

a first additional differential transmission line comprising a first additional plurality of conductors, wherein the first additional plurality of conductors comprises a first additional pair of conductors which define a first additional axis, wherein the first additional axis is substantially perpendicular to the first axis and dissects the first axis at substantially a midpoint of the first axis; and a second additional differential transmission line comprising a second additional plurality of conductors, wherein the second additional plurality of conductors comprises a second additional pair of conductors which define a second additional axis, wherein the second additional axis is substantially perpendicular to the second axis and dissects the second axis at substantially a midpoint of the second axis.

10. A method for facilitating signal transmission using differential transmission lines, comprising:

positioning a first differential transmission line of a plurality of differential transmission lines into a first position, the first differential transmission line comprising a first plurality of conductors, wherein the first plurality of conductors comprises a first pair of conductors, and wherein the conductors of the pair of conductors are separated by a first conductor distance;

positioning a second differential transmission line of the plurality of differential transmission lines into a second position, the second differential transmission line comprising a second plurality of conductors, wherein the second plurality of conductors comprise a first conductor and a second conductor, wherein the second position insures that the first conductor and the second conductor are separated from all of the first plurality of conductors by at least a first isolation distance, and wherein the first isolation distance is larger than the first conductor distance, wherein a first noise produced by the first conductor on the first pair of conductors is balanced by a second noise produced by the second conductor on the first pair of conductors in response to the first isolation distance being larger than the first conductor distance, wherein the plurality of differential transmission lines comprises positioned differential transmission lines, wherein each positioned differential transmission line comprises a pair of conductors, and wherein each pair of conductors defines an axis;

determining an additional isolation distance for each pair of conductors of the positioned differential transmission lines, wherein the additional isolation distance is larger than a distance between the conductors of the pair of conductors for each positioned differential transmission line, and wherein the additional isolation distance is a minimum distance needed between each pair of conductors and any other positioned differential transmission line to minimize noise coupling on the pair of conductors;

positioning additional positioned differential transmission lines of the plurality of differential transmission lines in additional positions, wherein each additional positioned differential transmission line of the plurality of differential transmission lines is positioned at least the additional isolation distance away from all previously positioned differential transmission lines of the plurality of differential transmission lines; and transmitting a signal using the first differential transmission line and the second differential transmission line.

11. The method of claim 10, wherein the first pair of conductors defines a first axis, wherein the first conductor and the second conductor define a second axis, wherein the second position is such that the first axis is substantially perpendicular to the second axis, and wherein positioning additional positioned differential transmission lines further comprises:

positioning at least one of the additional positioned differential transmission lines of the plurality of differential transmission lines in a first row corresponding to the first position and the second position, wherein the axis of each additional positioned differential transmission line of the plurality of differential transmission lines is substantially perpendicular to the axes of previously positioned differential transmission lines of the plurality of differential transmission lines that are proximately positioned.

12. The method of claim 11, wherein positioning additional positioned differential transmission lines further comprises:

positioning additional positioned differential transmission lines of the plurality of differential transmission lines in columns corresponding to the first row forming additional rows, wherein the differential transmission lines positioned in the rows and the columns are arranged in a grid pattern.

13. The method of claim 11, wherein positioning additional positioned differential transmission lines further comprises:

positioning additional positioned differential transmission lines of the plurality of differential transmission lines in columns corresponding to the first row forming additional rows, wherein the differential transmission lines positioned in the rows and the columns are arranged in a staggered pattern.

14. The method of claim 10, wherein the positioned differential transmission lines facilitate signal transmission in one of a via or a pin arrangement.

15. An apparatus for facilitating signal transmission using a plurality of differential transmission lines arranged in a pattern, the apparatus comprising:

a plurality of differential transmission lines, wherein each differential transmission line comprises a pair of conductors, wherein each pair of conductors defines an axis;

a first differential transmission line of the plurality of differential transmission lines positioned in a first position; and at least two additional differential transmission lines of the plurality of differential transmission lines positioned in additional positions in rows near the first differential transmission line, wherein each positioned additional differential transmission line of the plurality of differential transmission lines is positioned at least an isolation distance away from previously positioned differential transmission lines of the plurality of differential transmission lines, wherein the isolation distance is determined for each differential transmission line in the plurality of differential transmission lines, wherein the isolation distance is larger than a distance between the conductors of the pair of conductors for each differential transmission line of the plurality of differential transmission lines, wherein the isolation distance is a minimum distance needed between the pair of conductors and any positioned differential transmission line to minimize noise coupling on the pair of conductors, wherein the axis of the positioned additional differential transmission line is substantially perpendicular to the axes of previously positioned differential transmission lines that are positioned nearest to the positioned additional differential transmission line, and wherein the plurality of differential transmission lines facilitate signal transmission in one of a via or pin arrangement.

16. The apparatus of claim 15, wherein the apparatus further comprises:

additional differential transmission lines of the plurality of differential transmission lines positioned in columns, wherein the differential transmission lines positioned in the rows and the additional differential transmission lines positioned in the columns are arranged in a grid pattern.

17. The apparatus of claim 15, wherein the apparatus further comprises:

additional differential transmission lines of the plurality of differential transmission lines positioned in columns, wherein the differential transmission lines positioned in the rows and the additional differential transmission lines positioned in the columns are arranged in a staggered pattern.

* * * * *